United States Patent [19]

Miranker

[11] 4,219,948

[45] Sep. 2, 1980

[54] APPARATUS FOR PRESSING CLOTHING

[75] Inventor: Samuel Miranker, Brooklyn, N.Y.

[73] Assignee: Automatic Steam Products Corporation, Long Island City, N.Y.

[21] Appl. No.: 7,657

[22] Filed: Jan. 29, 1979

[51] Int. Cl.[3] ..... D06F 69/02; F26B 19/00

[52] U.S. Cl. ..... 38/10; 34/236

[58] Field of Search ..... 38/2, 3, 5, 8, 9, 10, 38/11, 15, 16, 17, 144; 34/236

[56] References Cited

U.S. PATENT DOCUMENTS

| | | | |
|---|---|---|---|
| 1,611,157 | 12/1926 | Bricker et al. | 38/10 |
| 1,756,498 | 4/1930 | Yanchenko | 38/10 |
| 1,840,814 | 1/1932 | Hunt | 38/10 |
| 2,038,050 | 4/1936 | Long | 68/9 |
| 2,807,894 | 10/1957 | Kramer | 38/10 |
| 3,451,600 | 6/1969 | Carruthers | 34/236 X |
| 3,673,702 | 7/1972 | Obrador | 34/236 X |
| 3,696,523 | 10/1972 | Beeley et al. | 34/236 X |
| 3,770,148 | 11/1973 | Hendren | 34/236 X |

*Primary Examiner*—Louis Rimrodt

*Attorney, Agent, or Firm*—James & Franklin

[57] ABSTRACT

An article of clothing carried on an upstanding planar form is continuously moved along a path which passes between a pair of upstanding pressing members mounted in closely spaced parallel relationship within a drying chamber. As the form enters the area between the pressing members, the members are separated by the form, against the action of springs urging the members towards each other. The opposing interior pressing surfaces of the members are each spring loaded into engagement with a different side of the article to smooth and press same as the form moves relative to the pressing members.

34 Claims, 6 Drawing Figures

APPARATUS FOR PRESSING CLOTHING

The present invention relates to pressing apparatus for clothing and the like and, more particularly, an apparatus which is adapted to be combined with drying apparatus to function to automatically smooth and press both sides of a garment.

Clothing manufacturers, commercial laundries and various other industries perform drying and/or pressing operations on clothing of various types. In the past, such operations have been performed separately, the drying being accomplished in a steam chamber or the like and the pressing being done manually or semi-automatically by a plurality of operations at different pressing stations. The separation of these operations requires materials handling operations in order to transport the garments from the drying chamber to the pressing tables. Thus, garment handling and pressing operations performed in this non-automated fashion, require a great deal of labor, time and plant space.

Rising labor and plant overhead costs and the inability to obtain reliable personnel have created a need to more fully automate the drying and pressing operations. Automated drying enclosures and the like are commercially available but are presently designed to perform the drying function only. Equipment capable of automating the pressing operation has been sought, and various types of semi-automatic and automatic pressing equipment have been designed; but for one reason or another, none of the presently available equipment has been capable of performing the pressing operation satisfactorily. Moreover, none of the automated pressing equipment presently available can be used in conjunction with commercial drying equipment to combine the drying and pressing operations to eliminate the time, labor costs and equipments costs of the intermediate handling operation.

In one type of known pressing apparatus, the article of clothing is placed on an intermittently movable form which travels between either a stationary support surface and a reciprocating pressing platen, or a pair of parallelly situated reciprocating pressing platens. One or both of the platens, depending upon the design of the equipment, is moved to separate the pressing surfaces thereon and the form is moved therebetween and stopped. The pressing surfaces, then located on either side of the form, are relatively moved together so as to press the article of clothing on the form. The surfaces are then relatively moved apart and the form is removed from its position between the surfaces, as a second form is moved into pressing position. Because of the intermittent character of the operation of this type of device, the speed of operation is relatively slow and the number of garments which can be pressed within a given time period is low. This type of apparatus requires a complicated mechanism to synchronize the movement of the garment with the reciprocation of the pressing surfaces or an operator to manually control the operations. Moreover, because the garment is not in engagement with the pressing surfaces as it is moved relative to the pressing surfaces in a direction parallel thereto, the article of clothing is not smoothed as it is pressed, such that wrinkles present in the garment may form unwanted creases in the pressed article.

Another type of conventional pressing apparatus comprises a continuously moving horizontal conveyor belt upon which folded articles of clothing are placed.

The belt carries the article of clothing along a table or the like between a spring-loaded presser shoe and a bottom support. This type of apparatus has the advantages of continuous operation and the application of a smoothing action, as compared to the aforementioned reciprocating platen-type of equipment. However, the smoothing and pressing action is applied only to the upward facing surface of the folded garment and, thus, if the downward facing surface is also to be smoothed and pressed, the folded garment must be manually turned over and fed through the machine a second time. Thus, when garments which must be pressed on both sides are processed, the speed of operation of such equipment is severely limited. Moreover, this type of apparatus cannot be used with a form designed to carry the article of clothing, and the garments must be situated horizontally as same are processed.

In commercial laundry operations, after the garments are washed, they must be dried, smoothed and pressed. Often, drying takes place within a drying chamber through which the wet garments travel on forms. The atmosphere in the drying chamber is heated, by steam or otherwise, in order to facilitate the drying operation. Since both the drying operation and the pressing operation require that heat be applied to the garment, energy would be conserved, the number of handling operations reduced, and plant space conserved if the smoothing and pressing operations could take place in the same chamber within which the drying is performed. However, the mechanical complexity and physical size of conventional pressing equipment, as described above, prohibits same from being located within conventional drying chambers.

It is therefore a prime object of the present invention to provide an apparatus for pressing an article of clothing which may be used in conjunction with a conventional drying chamber so as to combine the drying, smoothing and pressing operations to reduce materials handling operations, plant space, energy costs and equipment costs.

It is a second object of the present invention to provide apparatus for pressing articles of clothing wherein the smoothing and pressing operations take place automatically.

It is a third object of the present invention to provide apparatus for pressing articles of clothing wherein the apparatus operates continuously, significantly enhancing the volume of garments processed.

It is a fourth object of the present invention to provide apparatus for pressing an article of clothing wherein both sides of the garment are smoothed and pressed during the same operation.

It is another object of the present invention to provide apparatus for pressing articles of clothing wherein the pressing operation need not be synchronized with the movement of the articles.

It is a further object of the present invention to provide an apparatus for pressing an article of clothing which is relatively simple in design, inexpensive to maintain and operate, and requires a minimum of space.

In accordance with the present invention, apparatus for pressing an article of clothing is provided. The apparatus includes a form upon which the article is carried. First and second pressing members each comprising a pressing surface are mounted in substantially parallel relationship with the pressing surfaces located thereon facing each other. Means are provided for continuously moving the article carrying form along a path at least a portion of which passes between the pressing surfaces. The members are movable, by the passage of the article carrying form therebetween, from a first position, wherein the surfaces are in relatively close proximity to each other, to a second position, where the surfaces are relatively separated from each other and wherein each of the surfaces engages a different side of the article to smooth and press same, respectively. Means are provided for urging the members towards the first position.

The form which is utilized to carry the garments comprises a substantially planar frame or the like which extends in a direction substantially parallel to the first and second members as the form is moved therebetween. The moving means comprises a conveyor and the form is mounted in an upstanding relationship with respect to the conveyor.

In one embodiment, each of the pressing members is substantially planar in configuration and extends in a direction substantially parallel to the direction of form movement. Each member is resiliently mounted on a substantially planar support member which, in turn, is rigidly affixed to a base. Urging means, in the form of a leaf spring, is interposed between each pressing member and its support member so as to mount the former in spaced, substantially parallel relationship to the latter. Each of the pressing members comprises, at its forward end, a portion flared outwardly in a direction away from the path of movement of the form so as to facilitate entrance of the form between the pressing members.

In a second embodiment, the pressing members comprise a pair of freely rotatable rollers which are spring-loaded towards each other. The article carrying form travels between the rollers separating same against the bias of the springs and the action of the rollers on either side of the form smooths and presses the article carried thereon.

The pressing apparatus of the present invention is preferably located within a drying enclosure, such as a steam chamber or the like, such that the drying, smoothing and pressing operations may be conveniently combined, reducing the number of materials handling operations, reducing the amount of plant space required and eliminating the necessity for a separate heating unit to heat the pressing apparatus. The steam chamber is preferably provided with an entrance port and an exit port, through which the article carrying form passes as it travels along its path. The pressing apparatus is located within the chamber between the entrance and exit ports.

To these and other objects which may hereinafter appear, the present invention relates to an apparatus for pressing an article of clothing, as described in the following specification, and recited in the annexed claims, taken together with the accompanying drawings, wherein like numerals refer to like parts, and in which:

Figure 1:
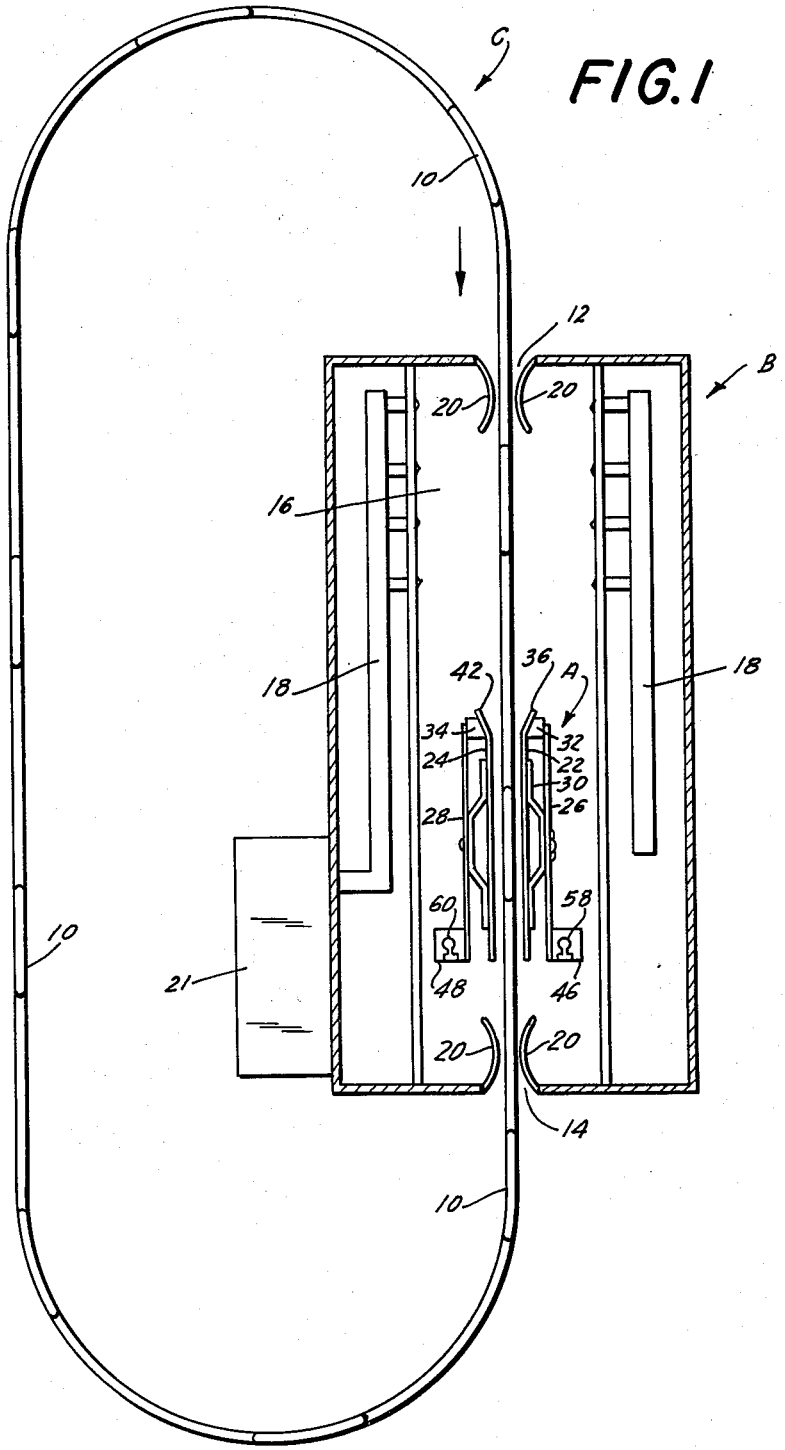
FIG. 1 is a top plan view of the first preferred embodiment of the present invention, showing same located within a drying enclosure.
Figure 2:
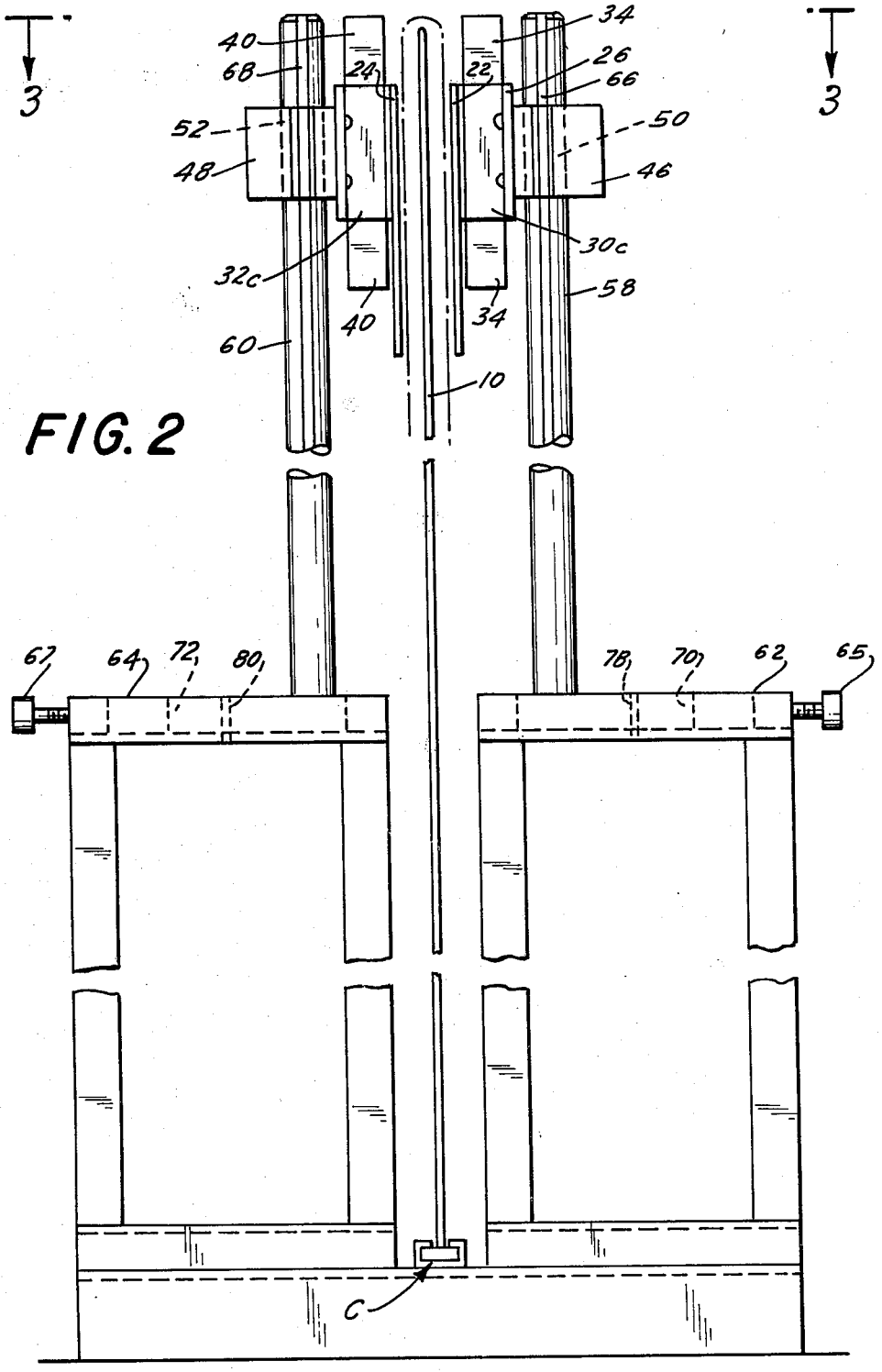
FIG. 2 is an end view of the first preferred embodiment of the present invention, shown in FIG. 1.

The first preferred embodiment of the present invention is illustrated in FIGS. 1 through 4. As seen in FIG. 1, the pressing apparatus, generally designated A, is preferably situated within a drying enclosure, generally designated B, of conventional design. A continuously movable conveyor system, generally designated C, is designed to move a plurality of spaced, upstanding, substantially planar forms 10 through drying enclosure B between an entrance port 12 located at one end of drying enclosure B and an exit port 14 located at the other end of drying enclosure B.

Drying enclosure B comprises a steam chamber 16 which is connected by means of steam conduits 18 to a steam generator 21. Perforations or openings are provided along the interior walls of steam chamber 16 which are connected to outlet ports in the steam carrying conduits 18 to permit entrance of steam into the steam chamber 16. It should be noted that drying enclosure B is shown schematically in FIG. 1. The particular design of the drying enclosure utilized in conjunction with the pressing apparatus forms no part of the present invention and the present invention should not be construed as being limited to the particular enclosure design shown. However, a variety of different types and sizes of drying enclosures utilizable in conjunction with the pressing apparatus of the present invention are available from a variety of different sources, such as Automatic Steam Products Corp. of Long Island City, N.Y.

In order to prevent steam from escaping through entrance port 12 and exit port 14 of steam chamber 16, each of these ports is provided with a pair of resilient sealing members 20 made of rubber or the like. Sealing members 20 of each pair are urged towards each other by the resiliency of the material of which the members are composed. Thus, the members normally seal each of the ports. However, as a form 10 passes through the port, the resilient sealing members 20 of each pair are separated by the moving form, as shown in FIG. 1, such that the form 10 may enter or leave the drying chamber. Once the form has moved from between the sealing members 20, the resiliency thereof causes the members to move together once again, sealing the port.

Figure 3:
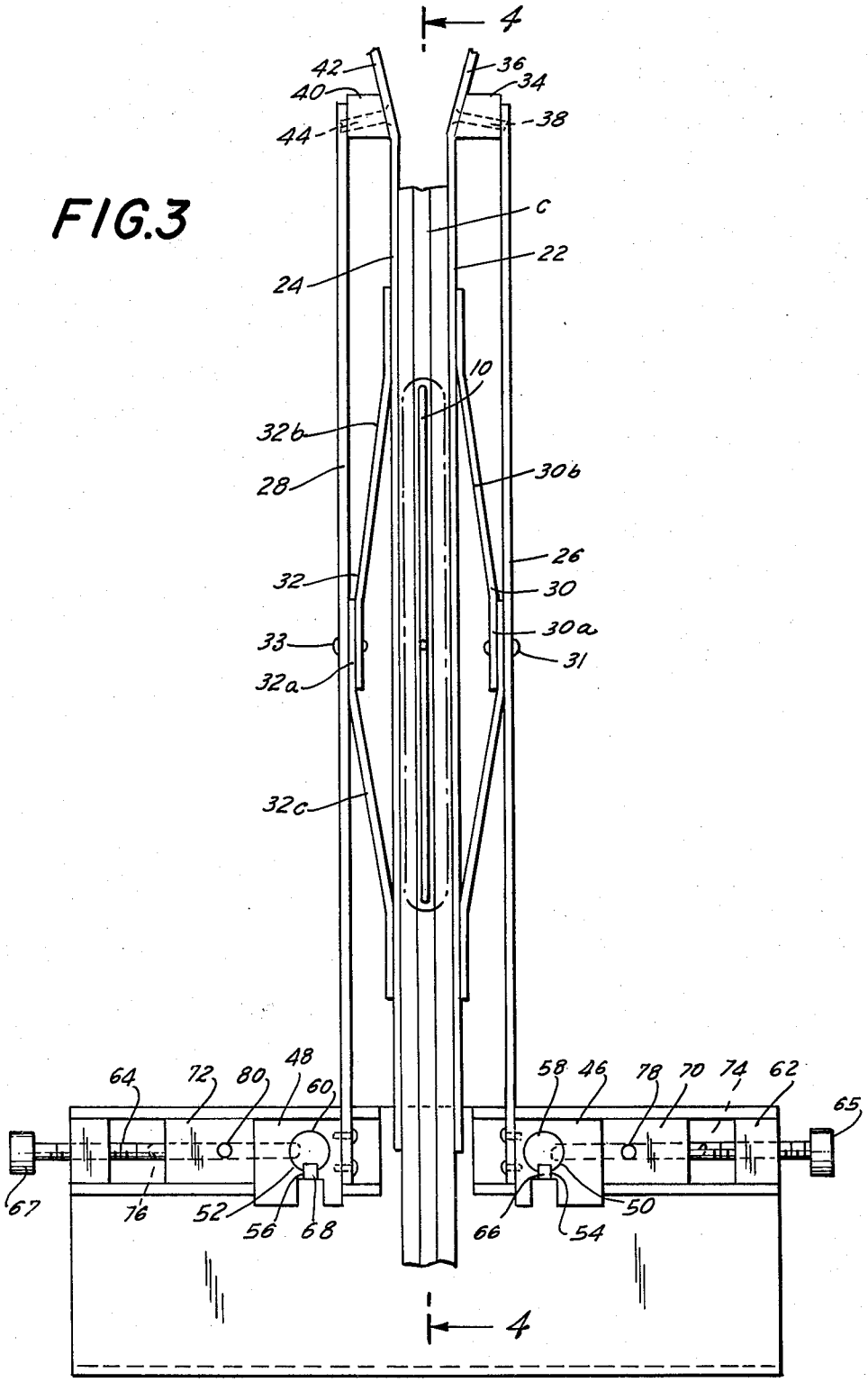
FIG. 3 is a top view of the first preferred embodiment of the present invention, taken along line 3—3 of FIG. 2.
Figure 4:
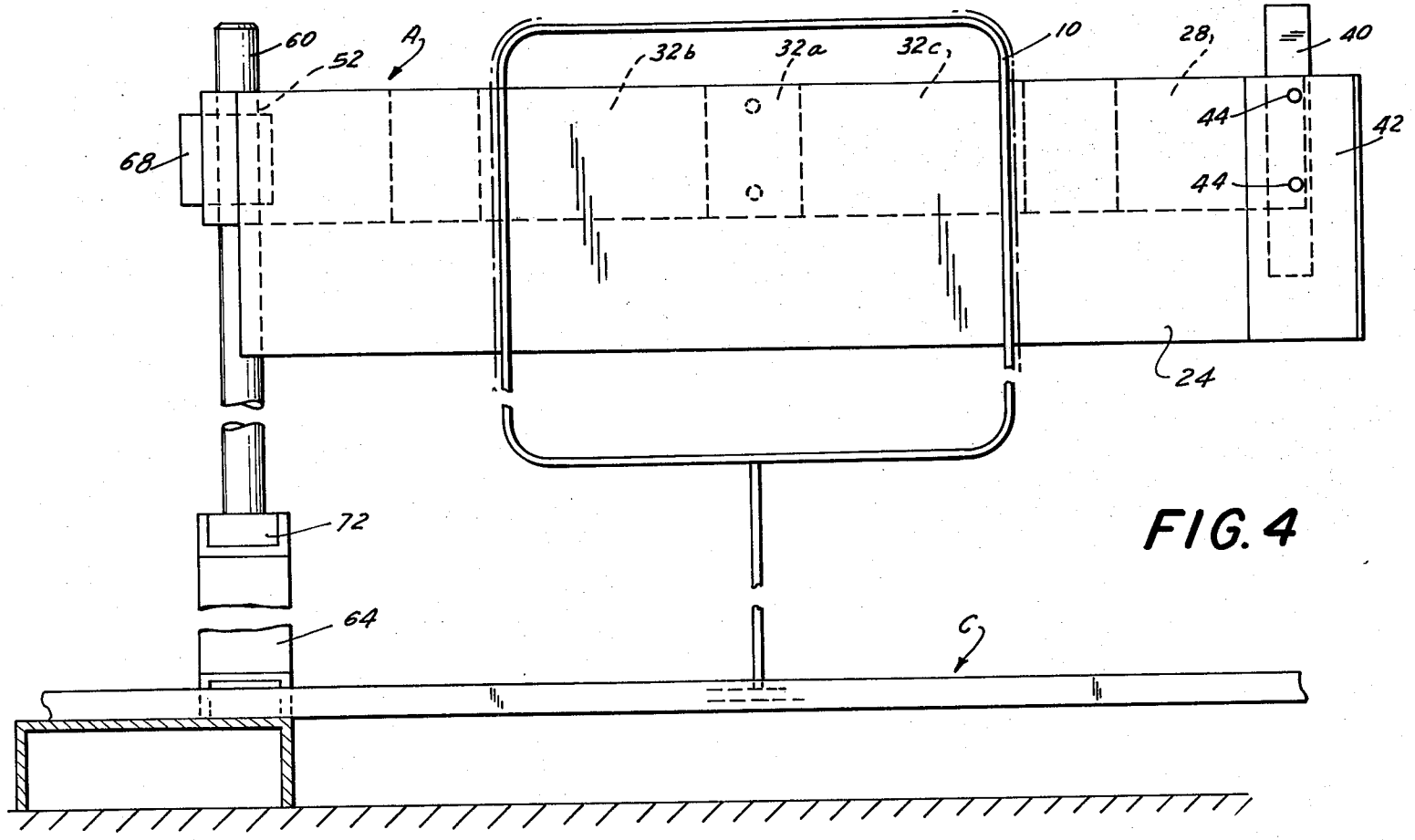
FIG. 4 is a side view of the first preferred embodiment of the present invention, taken along line 4—4 of FIG. 3.

As best seen in FIG. 3, the pressing apparatus comprises a pair of substantially planar pressing members 22, 24 which are mounted in substantially parallel relationship, such that the interior pressing surfaces thereof, preferably coated with TEFLON or other non-stick coating material, face each other. Each of the pressing members 22, 24 is mounted on a substantially planar support member 26, 28, respectively, by means of a leaf spring 30, 32, respectively. Leaf springs 30, 32 each have a base portion **30*a* and 32*a* affixed to the inner surface of support members 26 and 28, respectively, by means of a screw, or other conventional connecting device. Each of the leaf springs 30, 32 have a pair of outwardly and forwardly extending members 30*b*, 30*c* and 32*b*, 32*c*, respectively. The ends of members 30*b* and 30*c* are located adjacent to and are slideable along the exterior surface of pressing member 22. Similarly, members 32*b* and 32*c* of leaf spring 32 are located adjacent to and are slideable along the exterior surface of pressing member 24**.

Because of the structure of leaf springs 30 and 32, pressing members 22 and 24 are maintained in substantially parallel relationship and urged towards each other by the resiliency of the leaf springs. The pressing members are also connected to the respective support members at the forward end thereof. An inclined member 34 is interposed between the forward end of support member 26 and a point on pressing member 22 located adjacent the flared forward end 36 thereof and is connected thereto by means of a screw 38, or other suitable connecting device. Similarly, an inclined member 40 is connected between the forward end of support member 28 and a point on pressing member 24 adjacent the flared portion 42 thereof by means of a screw 44 or other conventional connecting device. It should be noted that the interior pressing surface of each of the pressing members 22, 24 must be designed not to catch or tear the garment as it is moved therealong. Thus, screws 38 and 44 are counter-sunk into the bodies of the respective pressing members, and the leaf springs are affixed to the exterior surface of support members 26 and 28 by means of screws 31, 33, respectively, or the like.

Flared sections 36 and 42 on pressing members 22 and 24, respectively, are provided at the forward end of the pressing apparatus to facilitate entrance of the form between the pressing members. The flared sections provide a camming action to separate the pressing members as the form 10 enters.

Support members 26 and 28 are rigidly mounted to a pair of brackets 46, 48, respectively, in cantilever fashion by means of screws, or the like. Each of the brackets 46 and 48 is provided with a vertical bore 50, 52 therethrough. Each of the vertical bores 50, 52 is provided with a vertically extending slot, or keyway 54, 56, respectively.

Brackets 46 and 48 are mounted on cylindrical shafts 58, 60 which extend vertically from bases 62, 64, respectively. Each of the shafts 58, 60 is provided with a protrusion or key 66, 68, respectively. Keys 66, 68 are receivable within the slots or keyways 54, 56, respectively, when vertically extending shafts 58, 60 are received within bores 50, 52, respectively. The presence of keys 66, 68 within keyways 54, 56, respectively, prevents relative rotation between the brackets 46, 48 and the shafts 58, 60 to which same are respectively connected. Brackets 46, 48 are thus vertically slideably connected to shafts 58, 60, respectively. Screws or other conventional connecting devices (not shown) are provided to secure the brackets to the shafts and may be loosened to move the brackets along the shafts to which same are mounted to adjust the height of the pressing members relative to the forms.

The lower portions of shafts 58 and 60 are affixed to blocks 70, 72, respectively, which are slideably received between parallelly situated, spaced upstanding walls on the top surface of bases 62 and 64, respectively. The top surfaces of bases 62 and 64 are provided with laterally extending slots 74, 76, respectively, into which screws 78, 80, extending from the underside of blocks 70, 72, respectively, are received. Position adjustment screws 65, 67 are provided at the ends of blocks 70, 72, respectively. By loosening screws 78, 80 and rotating adjustment screws 65, 67, blocks 70 and 72 can be moved laterally along the top surface of blocks 62, 64, respectively, between the upstanding walls thereon, in order to adjust the relative lateral spacing of support members 26, 28 and, thus, pressing members 22, 24, respectively.

In operation, an operator locates himself adjacent a convenient point on conveyor C, as seen in FIG. 1, and as upstanding forms 10 travel past the operator's station, garments to be dried and pressed, for example, T-shirts and the like, are placed on each of the forms 10. The garment containing forms 10 travel around conveyor C and through entrance port 12 in steam chamber 16 by temporarily opening sealing members 20 mounted adjacent entrance port 12. Once within the steam chamber 16, the garment is subjected to steam supplied through conduits 18, which are connected to steam generator 21, so as to dry the garment as same travels along the length of the drying chamber.

Approximately halfway down the chamber is situated the forward end of the pressing apparatus, which is provided with flared portions 36 and 42 to facilitate the entrance of the garment carrying form between the pressing members. As the garment carrying form moves between the pressing members 22 and 24, which are normally biased in close proximity to each other by leaf springs 30, 32, respectively, the pressing members 22, 24 are separated by the form but still maintained in a substantially parallel relationship by the mounting means. As the garment carrying form travels between pressing members 22 and 24, both sides of the garment are smoothed and pressed. The smoothing action takes place as the side of the garment is moved along the pressing surface in a direction parallel thereto. The pressing action takes place through the forces applied in a direction substantially perpendicular to the movement of the form by leaf springs 30 and 32, which are compressed by the presence of the form between the pressing members 22 and 24.

After the garment carrying form has passed between the pressing members 22 and 24 and exited the rear end of the pressing apparatus, the action of leaf springs 30, 32 cause the pressing members 22, 24 to return to their original position, in close proximity to each other. The garment carrying form continues to move along conveyor C until it approaches exit port 14, wherein it opens sealing members 20 and passes out the exit port at the rear of the drying chamber. The garment carrying form moves along conveyor C until it approaches the operator's station. The operator then removes the dried, smoothed and pressed garment from the form and replaces same with a garment which is to be dried, smoothed and pressed.

Figure 5:
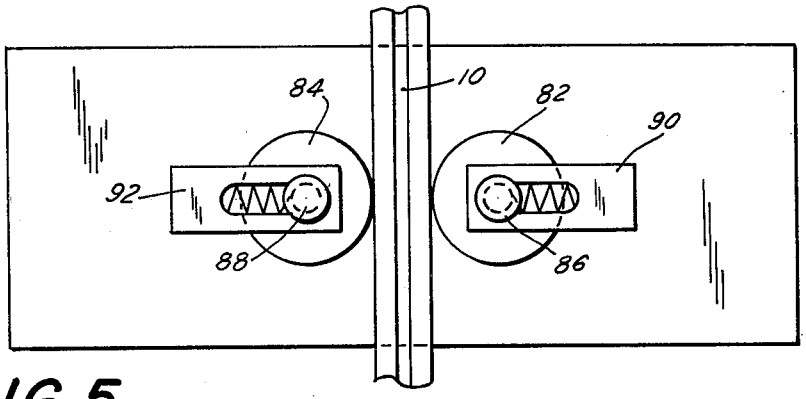
FIG. 5 is a top plan view of a second preferred embodiment of the present invention.
Figure 6:
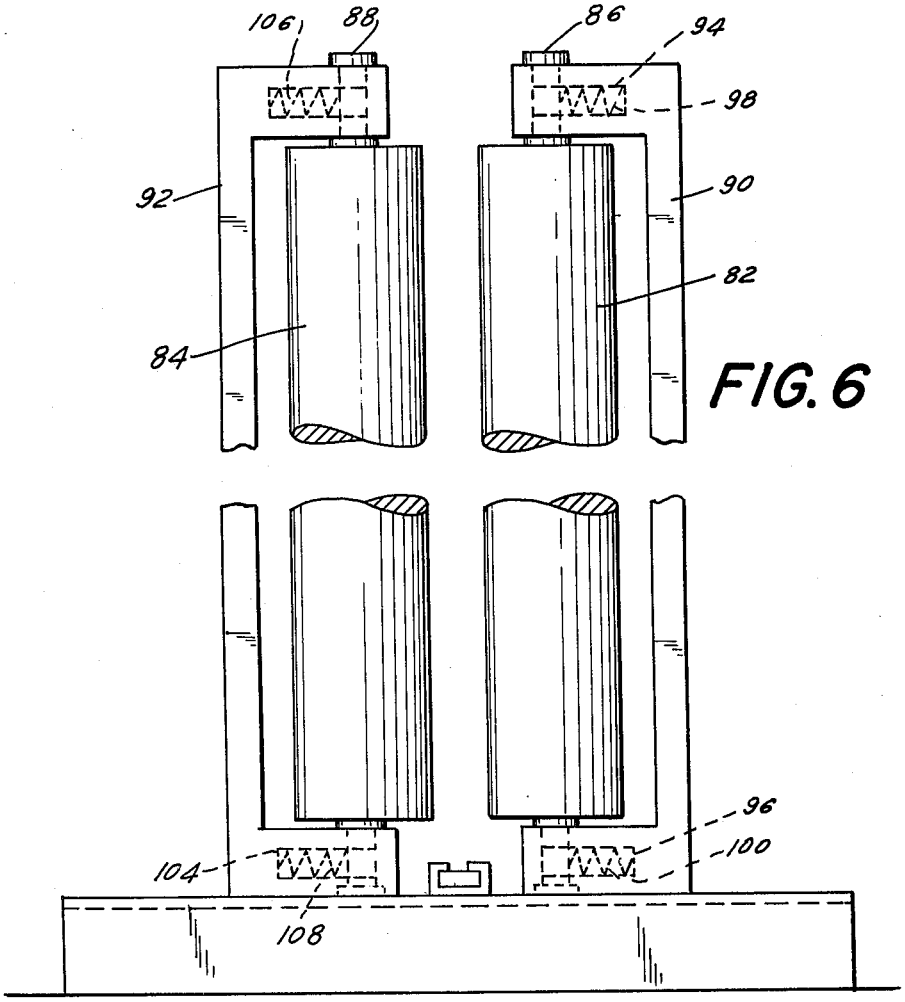
FIG. 6 is a front view of the second preferred embodiment of the present invention, illustrated in FIG. 5.

A second preferred embodiment of the present invention is illustrated in FIGS. 5 and 6. The second preferred embodiment may be situated within and function in conjunction with a drying enclosure in the identical manner described above with respect to the first preferred embodiment. In this embodiment, the pressing apparatus A takes the form of a pair of rollers 82, 84 which are freely rotatably mounted on shafts 86, 88, respectively. Each of the rollers 82, 84 is mounted to a generally "U"-shaped bracket 90, 92, respectively. Bracket 90 is provided with laterally extending slots 94, 96 at the top and bottom thereof, respectively, through which the ends of shaft 86 are received. Within each of the slots 94, 96 is situated a compression spring 98, 100 located between shaft 86 and the interior wall of the slot. In similar fashion, bracket 92 is provided with laterally extending slots 102 and 104 at the top and bottom thereof, into which shaft 88 is received. Compression springs 106 and 108 are situated within slots 102 and 104, respectively, between shaft 88 and the interior wall of the slot. Springs 98, 100 and 106, 108 serve to spring-load rollers 82 and 84 towards each other, such that as the garment carrying form 10 travels between the rollers, the form moves the rollers from a first position, wherein the rollers are in close proximity to each other, to a second position, where the rollers are relatively separated from each other, against the biasing force of the springs. This assures that the rollers will impart the necessary smoothing and pressing forces to both sides of the garment mounted on the form, as the garment carrying form travels therebetween.

It should now be understood that the present invention relates to a pressing apparatus which will smooth and press both sides of a garment simultaneously as the garment travels on a form through the apparatus. The operation of the apparatus is continuous and completely automated and does not require the presence of an operator to perform the function. Moreover, the pressing apparatus may be used in conjunction with a conventional drying chamber, or the like, so as to combine the drying, smoothing and pressing functions into a single operation, thereby eliminating the necessity for additional materials handling apparatus and/or personnel, resulting in a reduction of plant space required for these operations and an increase in productivity, as well as a decrease in labor costs.

While only two preferred embodiments of the present invention have been disclosed herein for purposes of illustration, it is obvious that many modifications and variations could be made thereto. It is intended to cover all of these variations and modifications which fall within the scope of the present invention, as defined by the following claims:

I claim:

1. Apparatus for pressing an article of clothing or the like comprising a form upon which the article is carried, first and second pressing members each comprising a pressing surface, means for mounting said members in substantially parallel relationship with said surfaces facing each other, means for continuously moving said article carrying form along a path at least a portion of which passes between said surfaces, said members being movable, by the passage of said article carrying form therebetween, from a first position, wherein said surfaces are in relatively close proximity to each other, to a second position, wherein said surfaces are relatively separated from each other and wherein each of said surfaces engages a different side of the article to smooth and press same, respectively, and means for urging said members towards said first position.

2. The apparatus of claim 1, wherein said form has a substantially planar configuration.

3. The apparatus of claim 2, wherein said form extends in a direction substantially parallel to said first and second members when said form is moved along said portion of said path.

4. The apparatus of claim 1, wherein said moving means comprises a conveyor and wherein said form is mounted in upstanding relationship with respect to said conveyor.

5. The apparatus of claim 4, wherein each of said pressing members is substantially planar and extends in the direction substantially parallel to the direction of form movement along said portion of said path.

6. The apparatus of claim 1, wherein said urging means comprises a leaf spring.

7. The apparatus of claim 1, wherein each of said pressing members is substantially planar and extends in the direction substantially parallel to the direction of form movement along said portion of said path.

8. The apparatus of claim 7, wherein said mounting means comprises a support, a substantially planar support member affixed to said support and extending therefrom in a direction generally parallel to said portion of said path and means for resiliently mounting said pressing member to said support member in spaced, substantially parallel relationship thereto.

9. The apparatus of claim 8, wherein said resilient mounting means comprises said urging means.

10. The apparatus of claim 9, wherein said urging means comprises a leaf spring.

11. The apparatus of claim 10, wherein said leaf spring comprises a base portion and a pair of outwardly and forwardly extending resilient arm portions, said base portion being operably connected to said support member and said arm portions being operably connected to said pressing member.

12. The apparatus of claim 8, further comprising a spacing element operably connecting the forward end of said support member to the forward end of said pressing member.

13. The apparatus of claim 12, wherein said support is affixed to the rear end of said support member.

14. The apparatus of claim 8, wherein said support comprises a base, a connecting member extending from said base, a bracket mounted on said connecting member, means for keying said bracket to said connecting member and means for affixing said support member to said bracket.

15. The apparatus of claim 7, wherein each of said pressing members further comprises a portion flared outwardly of said portion of said path so as to facilitate entrance of said article carrying form between said pressing members.

16. The apparatus of claim 1, wherein each of said pressing members comprises a roller and wherein said mounting means comprises a shaft to which said roller is freely rotatably mounted and which extends from said roller along the axis of rotation of said roller at one end thereof and a bracket having a slot therein adapted to receive said shaft, said slot extending in a direction generally perpendicular to said shaft.

17. The apparatus of claim 16, wherein said urging means comprises a spring interposed within said slot between the wall thereof and said shaft.

18. The apparatus of claim 1, further comprising means for heating said pressing members.

19. The apparatus of claim 18, wherein said heating means comprises a steam chamber within which said pressing members are located.

20. The apparatus of claim 19, wherein said chamber has an entrance port and an exit port through which said article carrying form passes as it travels along said path.

21. The apparatus of claim 20, wherein said portion of said path is situated between said ports.

22. In combination, drying apparatus comprising a heated enclosure, a form upon which an article of clothing is carried, means for moving said form through said enclosure, and apparatus for pressing the article of clothing as same is moved through said enclosure, said pressing apparatus comprising: first and second pressing members, each comprising a pressing surface, means for mounting said members in substantially parallel relationship with said pressing surfaces facing each other, said moving means continuously moving said article carrying form along a path at least a portion of which passes between said pressing surfaces, said members being movable, by the passage of said article carrying form therebetween, from a first position, wherein said pressing surfaces are in relatively close proximity to each other, to a second position, wherein said pressing surfaces are relatively separated from each other and wherein each of said pressing surfaces is in engagement with a different side of the article to smooth and press same, respectively, and means for urging said members towards said first position.

23. The combination of claim 22, wherein each of said pressing members is substantially planar and extends in the direction substantially parallel to the direction of form movement along said portion of said path.

24. The combination of claim 23, wherein said urging means comprises a leaf spring.

25. The combination of claim 23, further comprising a spacing element operably connecting the forward end of said support member to the forward end of said pressing member.

26. The combination of claim 23, wherein each of said pressing members further comprises a portion flared outwardly of said path so as to facilitate entrance of said article carrying form between said pressing members.

27. The combination of claim 22, wherein said mounting means comprises a support, a substantially planar support member affixed to said support and extending therefrom in a direction generally parallel to said portion of said path and means for resiliently mounting said pressing member to said support member in spaced, substantially parallel relationship thereto.

28. The combination of claim 27, wherein said resilient mounting means comprises said urging means.

29. The combination of claim 28, wherein said urging means comprises a leaf spring.

30. The combination of claim 29, wherein said leaf spring comprises a base portion and a pair of outwardly and forwardly extending resilient arm portions, said base portion being operably connected to said support member and said arm portions being operably connected to said pressing member.

31. The combination of claim 27, wherein said support is affixed to the rear end of said support member.

32. The combination of claim 27, wherein said support comprises a base, a connecting member extending from said base, a bracket mounted on said connecting member, means for keying said bracket to said connecting member and means for affixing said support member to said bracket.

33. The combination of claim 22, wherein each of said pressing members comprises a roller and wherein said mounting means comprises a shaft to which said roller is freely rotatably mounted and which extends outwardly from said roller along the axis of rotation of said roller at one end thereof and a bracket having a slot therein, said slot extending in a direction generally perpendicular to said shaft.

34. The combination of claim 33, wherein said urging means comprises a spring interposed within said slot between the wall thereof and said shaft.

* * * * *